US007162817B2

(12) United States Patent
Stock

(10) Patent No.: US 7,162,817 B2
(45) Date of Patent: Jan. 16, 2007

(54) WHEEL LOADER

(75) Inventor: Josef Stock, Bischofshofen (AT)

(73) Assignee: Liebherr-Werk Bischofshofen GmbH, Bischofshofen (AT)

( * ) Notice: Subject to any disclaimer, the term of this patent is extended or adjusted under 35 U.S.C. 154(b) by 84 days.

(21) Appl. No.: 10/478,585

(22) PCT Filed: May 22, 2002

(86) PCT No.: PCT/EP02/05619

§ 371 (c)(1),
(2), (4) Date: May 21, 2004

(87) PCT Pub. No.: WO02/095142

PCT Pub. Date: Nov. 28, 2002

(65) Prior Publication Data

US 2004/0194355 A1 Oct. 7, 2004

(30) Foreign Application Priority Data

May 17, 2001 (DE) ..... 201 11 768 U
May 22, 2001 (DE) ..... 201 08 606 U

(51) Int. Cl.
*E02F 3/72* (2006.01)

(52) U.S. Cl. ..... 37/408; 37/403; 414/695; 414/722

(58) Field of Classification Search ..... 37/408, 37/403, 468; 414/722, 727, 694, 695
See application file for complete search history.

(56) References Cited

U.S. PATENT DOCUMENTS 3,891,108 A 6/1975 Traficant
3,927,781 A * 12/1975 Okabe ..... 414/700
4,156,488 A * 5/1979 Stark ..... 414/697
4,271,613 A * 6/1981 Ferrero ..... 37/443
4,301,607 A * 11/1981 Inui ..... 37/415
4,382,744 A * 5/1983 Klem et al. ..... 414/712
4,798,512 A * 1/1989 Intveld ..... 414/722
5,595,471 A * 1/1997 Ajilore ..... 414/685
5,695,310 A * 12/1997 Foster et al. ..... 414/685

(Continued)

FOREIGN PATENT DOCUMENTS

DE 1179511 10/1964

(Continued)

*Primary Examiner*—Thomas A Beach
(74) *Attorney, Agent, or Firm*—Dilworth & Barrese LLP

(57) ABSTRACT

The lifting frame with Z-kinematics of a wheel loader comprises an accessory arm with a lifting cylinder coupled to the vehicle frame or to the truck front-end and a rocker-type reversing lever coupled to the accessory arm, to the ends of which reversing lever the tipping cylinder and the connecting link are coupled for the swivelling of the attachment. Attachments, e.g. a bucket or a log loader, are mountable on the lifting frame. In order to be able, in a raised position of the lifting frame, to swivel the attachment with the necessary large moment from a position tipped downwards into a position tipped upwards, without any reinforcement of the tipping cylinder, there is coupled with the lifting frame, in the direction of the attachment in front of the articulated joint connecting the tipping cylinder to the vehicle frame, at least one hydraulic cylinder, whereof the piston rod engages in an articulated manner with the swivel axle connecting the reversing lever with the tipping cylinder.

19 Claims, 11 Drawing Sheets

U.S. PATENT DOCUMENTS 5,993,139 A * 11/1999 Deneve et al. ..... 414/722
6,099,236 A * 8/2000 Wiechman ..... 414/708
6,116,847 A * 9/2000 Ginn et al. ..... 414/722

FOREIGN PATENT DOCUMENTS

DE 2444288 4/1975
DE 2832885 2/1980
DE 268459 5/1989
DE 3930529 8/1990

* cited by examiner

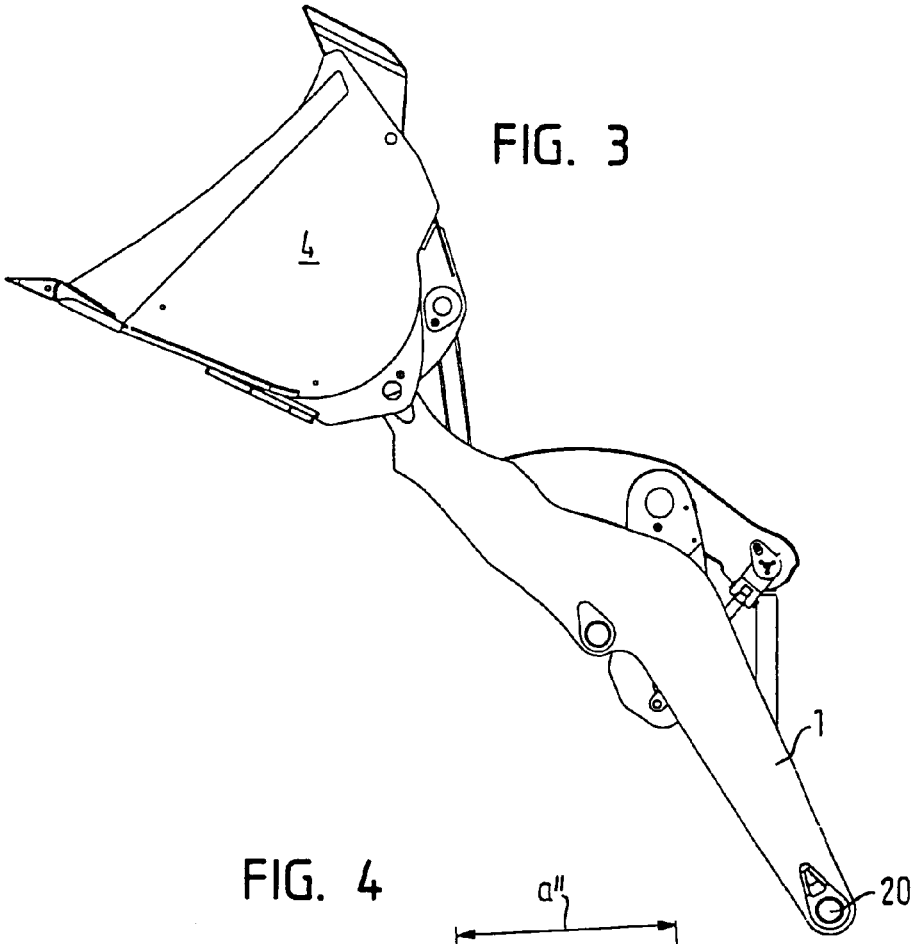
FIG. 3
FIG. 4
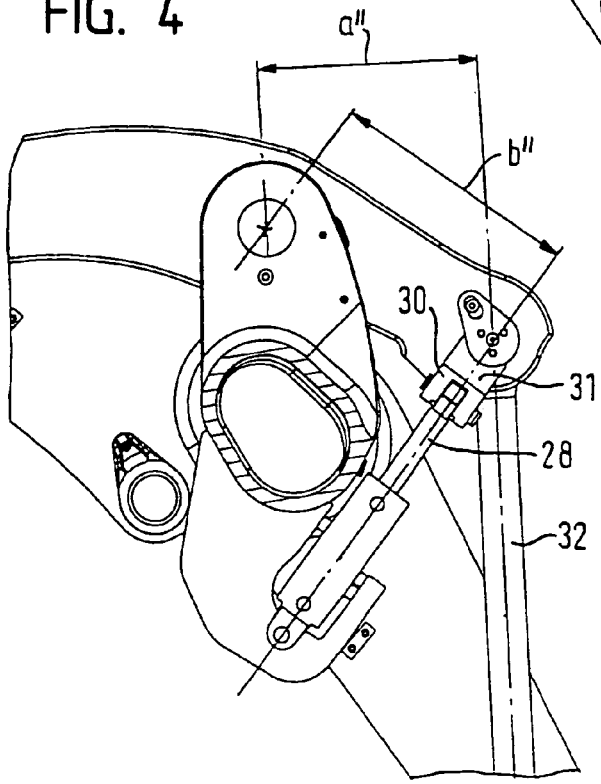

WHEEL LOADER

BACKGROUND OF THE INVENTION

The invention relates to a wheel loader with a lifting frame with Z-kinematics, which comprise an accessory arm with a lifting cylinder coupled to the vehicle frame or to the truck front-end and a rocker-type reversing lever coupled to the accessory arm, to the ends of which reversing lever the tipping cylinder and the connecting link are coupled for the swivelling of the attachment, whereby attachments, e.g. a bucket or a log loader, are mountable on the lifting frame.

A known wheel loader of this kind is shown in FIG. 8 of the drawing. With the latter, accessory arm 1 is designed H-shaped, whereby the lateral carriers parallel to one another are connected at their inner ends by means of articulated joints 2 to the truck front-end, which is usually connected by a folding articulated joint to the truck rear. The front ends of the lateral carriers are connected in an articulated manner by articulated joints 3 to an attachment, in the represented example of embodiment to a bucket 4. The lateral carriers are connected together in their middle region by a transverse tube 5 forming the H-web. Transverse tube 5 carries in its middle region cheeks 6 which are parallel to one another and form a bearing fork, between which cheeks reversing lever 7 of the Z-kinematics is mounted in the manner shown. The piston rod of tipping cylinder 9 is coupled in articulated joint 8 to one end of reversing lever 7, said tipping cylinder for its part being connected in an articulated manner by articulated joint 10 to the truck front-end. Connecting link 12 is connected in an articulated manner in articulated joint 11 to the other end of reversing lever 7, said connecting link being connected in an articulated manner by articulated joint 13 to the attachment. Accessory arm 1 is capable of swivelling about its articulated joint 2 by means of lifting cylinders 14, which are connected in a swivelling manner by articulated joints 15 to the truck front-end, whilst their piston rods are connected in a swivelling manner by means of articulated joints 16 to accessory arm 1.

Bucket 4 is shown in three different positions I, II and III in FIG. 8.

In position I, in which the bucket is in the area of the ground, the tipping cylinder engages via a large lever arm with reversing lever 7, so that the bucket can be swivelled without problem about its swivel axle 3 on the accessory arm. The situation changes, however, when the accessory arm is raised, when bucket 4 is intended to be swivelled between positions II and III. When accessory arm 1 is raised, tipping cylinder 9 in position II of the bucket tipped downwards engages solely via lever arm a with reversing lever 7. In position IIII of bucket 4 swivelled upwards, the effective lever arm b is enlarged, as can be seen from FIG. 8. In order to be able, in the presence of a high loading of the attachment, for example when a log loader is loaded, to swivel the latter between positions II and III with the raised lifting frame, high forces must therefore be applied by lifting cylinder 9, which however requires a large tipping cylinder 9, which is not necessary for the operation in other swivelling positions and therefore, apart from unnecessarily high costs, would also lead to unnecessarily high loading of the bolts and articulated connections, causing correspondingly greater wear.

The problem of the invention, therefore, is to provide a wheel loader of the type mentioned at the outset, with which, in a raised position of the lifting frame, the attachment can be swivelled with the necessary large moment from a position tipped downwards into a position tipped upwards, without any reinforcement of the tipping cylinder.

SUMMARY OF THE INVENTION

According to the invention, this problem is solved by the fact that at least one hydraulic cylinder is coupled with the lifting frame, the piston rod of which hydraulic cylinder engages in an articulated manner with the swivel axle connecting the reversing lever with the tipping cylinder.

This hydraulic cylinder provided according to the invention forms a supporting cylinder which, in the raised position of the lifting frame, is capable of swivelling the attachment between its end positions with the necessary moment, without the tipping cylinder itself having to be reinforced.

It is expedient for pressure oil to be applied to the supporting hydraulic cylinder simultaneously together with the tipping cylinder. This configuration ensures that the hydraulic cylinder always produces a supporting turning moment for swivelling the attachment upwards when the tipping cylinder is extended.

If the attachment, for example a log loader, is tipped downwards from its raised position, the attachment strives to fall into the downward-tipped position on account of the gravity effect of the load. According to a preferred form of embodiment of the invention, therefore, provision is made such that the supporting hydraulic cylinder is engaged as a damping cylinder when the tipping cylinder performs a movement retracting the piston rod. This damping effect is achieved by the fact that the oil forced out of the supporting hydraulic cylinders is conveyed back into the tank through the same line that also connects the tipping cylinder with the tank, so that the necessary throttling takes place in this line. It would of course also be possible to provide throttle valves for throttling the oil forced out of the supporting hydraulic cylinders, said throttle valves being switched on when required.

The supporting effect for the hydraulic cylinder is basically only required in a relatively small area, i.e. with the lifting frame raised, in the area in which, when the attachment is being tipped, the tipping cylinder engages with the reversing lever solely via the relatively short lever. In order to achieve a supporting and, if necessary, damping effect of the hydraulic cylinder solely in this critical area, provision is made in a further development of the invention such that the hydraulic cylinder is held on the lifting frame in such a way as to have a limited swivelling capacity and its piston rod carries an open saucer-shaped support bearing, which disengages from the swivel axle connecting the reversing lever with the tipping cylinder when, with the lifting frame raised and with the attachment swivelled upwards, the tipping cylinder engages with the reversing lever via the longer lever arm.

With an accessory arm designed H-shaped and with a reversing lever coupled to the transverse tube forming the H-web, it is expedient for the transverse tube to be provided with bearing pieces for the coupling of the hydraulic cylinder.

Two hydraulic cylinders are preferably connected to the transverse tube in such a way as to have a limited swivelling capacity, the piston rods of which hydraulic cylinders are connected together by a cross yoke which carries the support bearing. The swivel axle, with which the piston rod of the tipping cylinder engages, can be lengthened laterally over the legs of the bearing fork connecting the latter with the reversing lever thereby forming axle-end pivots, whereby lateral support bearings connected to the cross yoke engage with these axle-end pivots.

It is expedient for each of the two hydraulic cylinders to be connected to the transverse tube by a U-shaped holding part, one leg of which is welded to the transverse tube, whereby the hydraulic cylinder is connected to the web part of the holding part about a swivel axis parallel to the transverse tube and the legs are provided on their insides with buffering stops, between which the cylinders are capable of swivelling.

The preceding description concerns a first form of embodiment of the invention, in which the piston rods, or the support bearings of the supporting hydraulic cylinders carried by the piston rods, are temporarily disengaged from the swivel axle connecting the reversing lever with the tipping cylinder. According to a second form of embodiment of the invention, therefore, provision is made such that the piston rods of the supporting hydraulic cylinders are connected in an articulated manner with the reversing lever in all the swivel positions of the lifting frame or the attachment. This is achieved according to the invention by the fact that one end of a guide lever is coupled with the reversing lever or with a radial arm or a bearing leg of the transverse tube connecting the lateral accessory arms in an H-shape, a side of a supporting hydraulic pressure-medium piston-cylinder unit being connected in an articulated manner to the other end of said guide lever, that the other end of the pressure-medium piston-cylinder unit is coupled with or in the vicinity of the swivel axle connecting the reversing lever with the tipping cylinder, and that the guide lever rests temporarily on the transverse tube for the purpose of supporting the tipping cylinder during the extension of the pressure-medium piston-cylinder unit.

This configuration of the wheel loader according to the invention has the advantage over the first form of embodiment that the supporting hydraulic cylinder is permanently connected in an articulated manner with the reversing lever on the one hand and with the guide lever on the other hand.

The guide lever is basically supported in the same swivel positions or operating situations on the transverse tube as the piston rods or the support bearings carried by the latter on the reversing lever or the swivel axle connecting the reversing lever with the tipping cylinder.

It is expedient for the guide lever to be mounted in an articulated manner on the swivel axle of the reversing lever, said swivel axle being held by fork-shaped bearing legs connected to the transverse tube.

Two parallel guide levers are preferably mounted on each side of the reversing lever, said guide levers being connected together in a U-shape by a web part, whereby there are mounted on the guide levers or the web part two pressure-medium piston-cylinder units whose other ends are connected in an articulated manner with projecting axle-end pivots of the swivel axle connecting the reversing lever with the tipping cylinder.

BRIEF DESCRIPTION OF THE DRAWINGS

Examples of embodiment of the invention will be explained below in greater detail with the aid of the drawing. The figures show the following.

DESCRIPTION OF THE PREFERRED EMBODIMENTS

Figure 8:
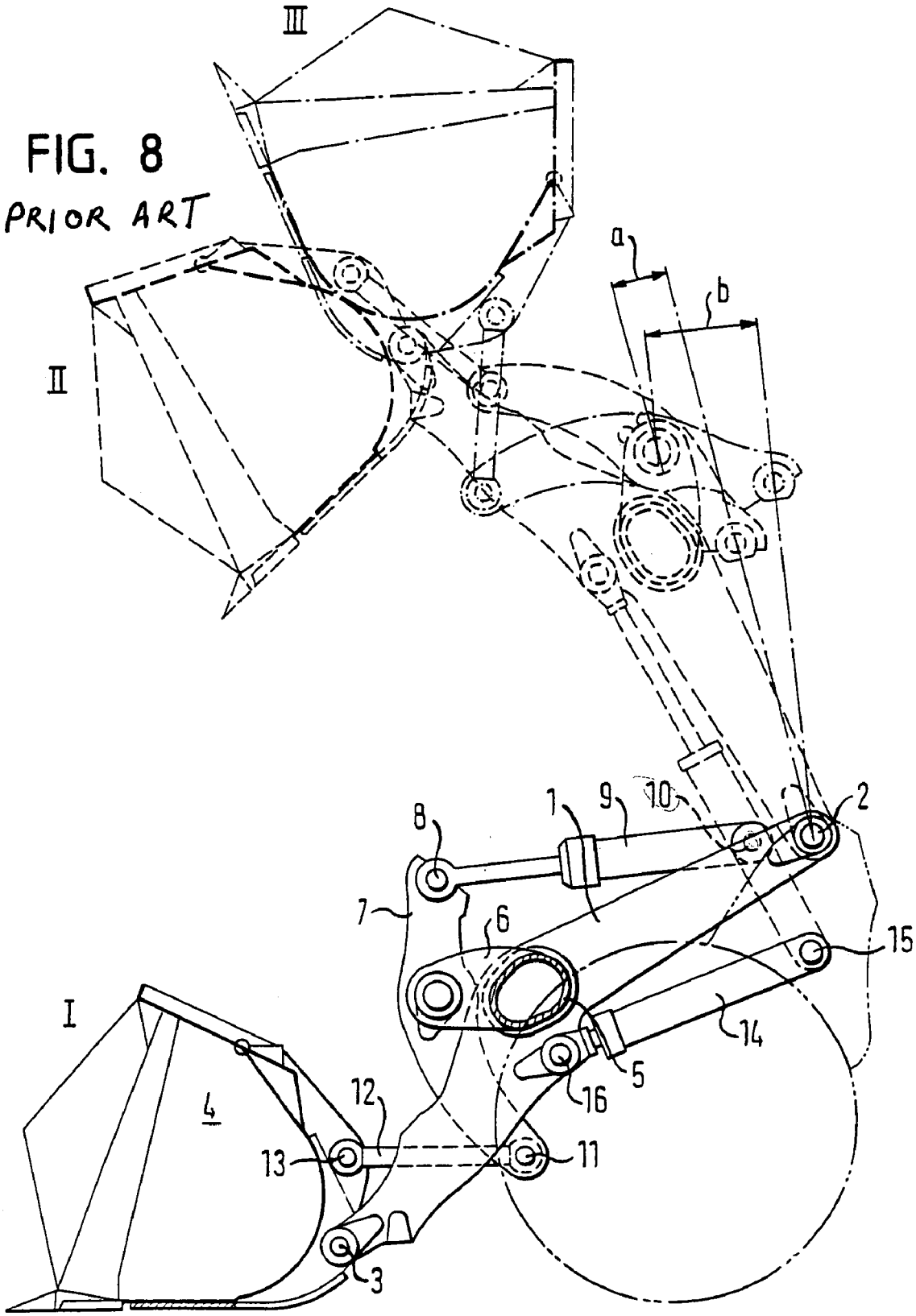
FIG. 8 PRIOR ART

Lifting frame 1 with mounted bucket 4 shown in FIGS. 1 to 7 corresponds, except for the supporting hydraulic cylinders provided according to the invention, to the known lifting frame with Z-kinematics according to FIG. 8.

The rear ends of the lateral carriers of accessory arm 1 designed H-shaped are provided with aligned bearing holes 20, with which the latter are mounted in a swivelling manner on the axle-end pivot pins of the truck front-end. To the transverse tube connecting the lateral carriers of accessory arm 1, there are welded holding parts 21 at a distance from one another and symmetrical to the transverse central plane of the accessory arm, on the side opposite fork-shaped bearing cheeks 6, said holding parts having U-shaped cut-outs on their side facing the truck front-end. The U-shaped cut-outs of holding parts 1 have a narrow leg 22 pointing towards the truck front-end and a wider leg 23 pointing towards the shovel, which wider leg has a cut-out corresponding to the contour of transverse tube 5 and is welded to transverse tube 5. Supporting hydraulic cylinders 24, 25 are mounted in the U-shaped cut-outs of holding parts 21. For this purpose, hydraulic cylinders 24, 25 have at their bottoms forked legs 26, which are provided with aligned holes and are mounted in a swivelling manner on bolts held in the web parts of U-shaped holding parts 21. On the insides of the flanks of the U-shaped cut-outs there are fixed cushioning rubber buffers 27, against which hydraulic cylinders 24, 25, which are capable of swivelling about a small angle in the U-shaped cut-outs, rest in their end positions. Piston rods 28, 29 are connected in an articulated manner with a cross yoke 30, which has saucer-shaped support bearings 31 on its two ends. The bolt supporting piston rod 32 and mounted in aligned holes of cheeks 33 of the forked bearing of reversing lever 7 is extended beyond the side bearing cheeks to form axle-end pivots, upon which cylindrical bearing rings 34 are placed. Bearing shells 31 of cross yoke 30 are supported on the axle-end pivots projecting beyond the bearing cheeks, or more precisely on bearing rings 34.

For the coupling of piston rods 28, 29 to cross yoke 30, the latter is provided at it ends with forked legs with aligned holes, whereby bearing bolts 36 are held in the aligned holes, said bearing bolts passing through bearing holes of piston rods 28, 29.

Pressure oil is always applied to supporting cylinders 24, 25 when pressure oil is also being applied to tipping cylinder 9.

Figure 1:
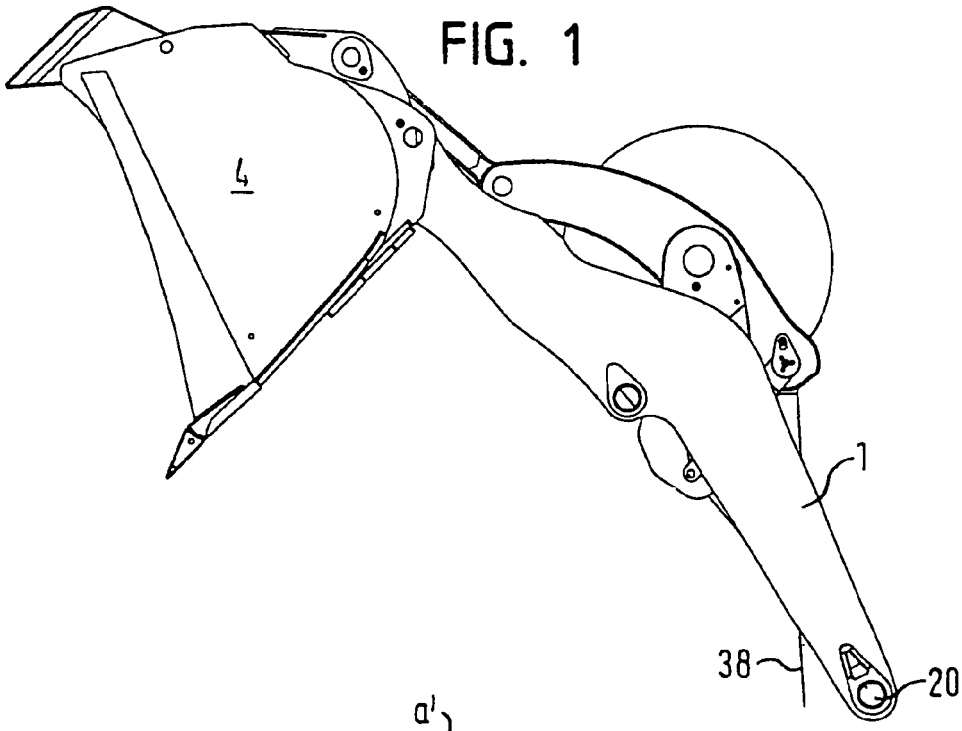
FIG. 1 a side view of the lifting frame with a mounted bucket with the supporting hydraulic cylinder according to the invention in a position corresponding to position II of FIG. 8, FIG. 2 a section from FIG. 1 in the area of the reversing lever in an enlarged representation, FIG. 3 a side view of the lifting frame according to FIG. 1 in a position corresponding to position III in FIG. 8, FIG. 4 an enlarged section from FIG. 3 corresponding to FIG. 2, FIG. 5 a perspective view of the section of the lifting frame according to FIG. 2, FIG. 6 a perspective view of a section of the lifting frame according to FIG. 4, FIG. 7 a perspective view of a section of the lifting frame according to FIGS. 5 and 6 in a position in which the supporting hydraulic cylinders are disengaged, FIG. 8 a known lifting frame with a mounted bucket in different positions I, II and III, and FIG. 9–16 a second form of embodiment of the lifting frame according to the invention with a mounted bucket in different positions, in which the supporting hydraulic cylinder is coupled on the one hand with a web part of a U-shaped, shovel-type carrying part and on the other hand with the projecting axle-end pivots of the swivel axle connecting the reversing lever with the tipping cylinder.
Figure 2:
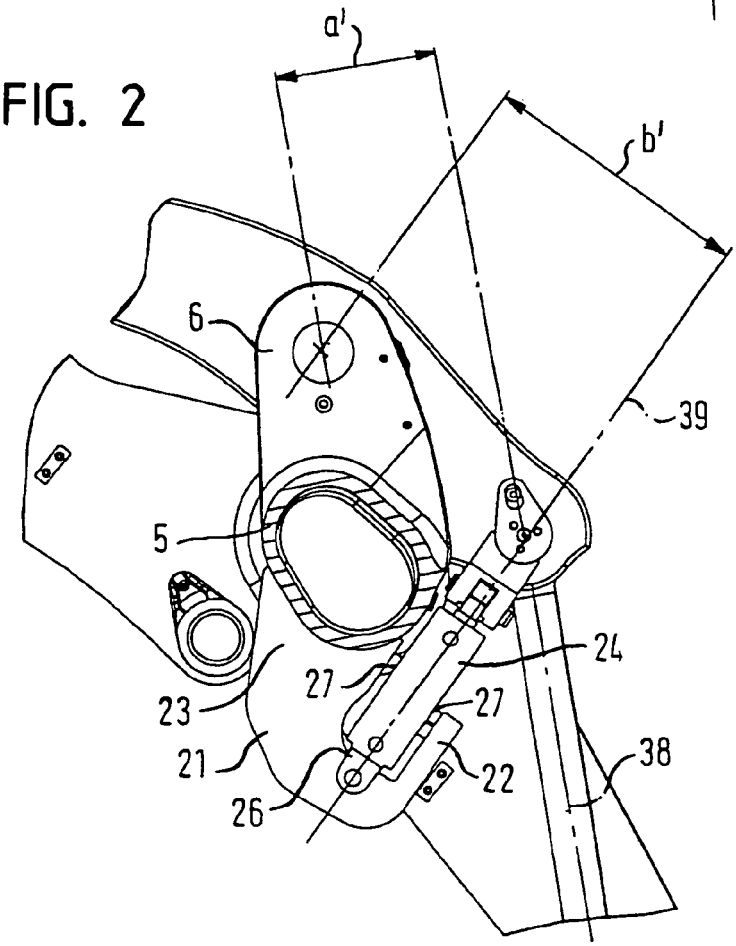
Figure 5:
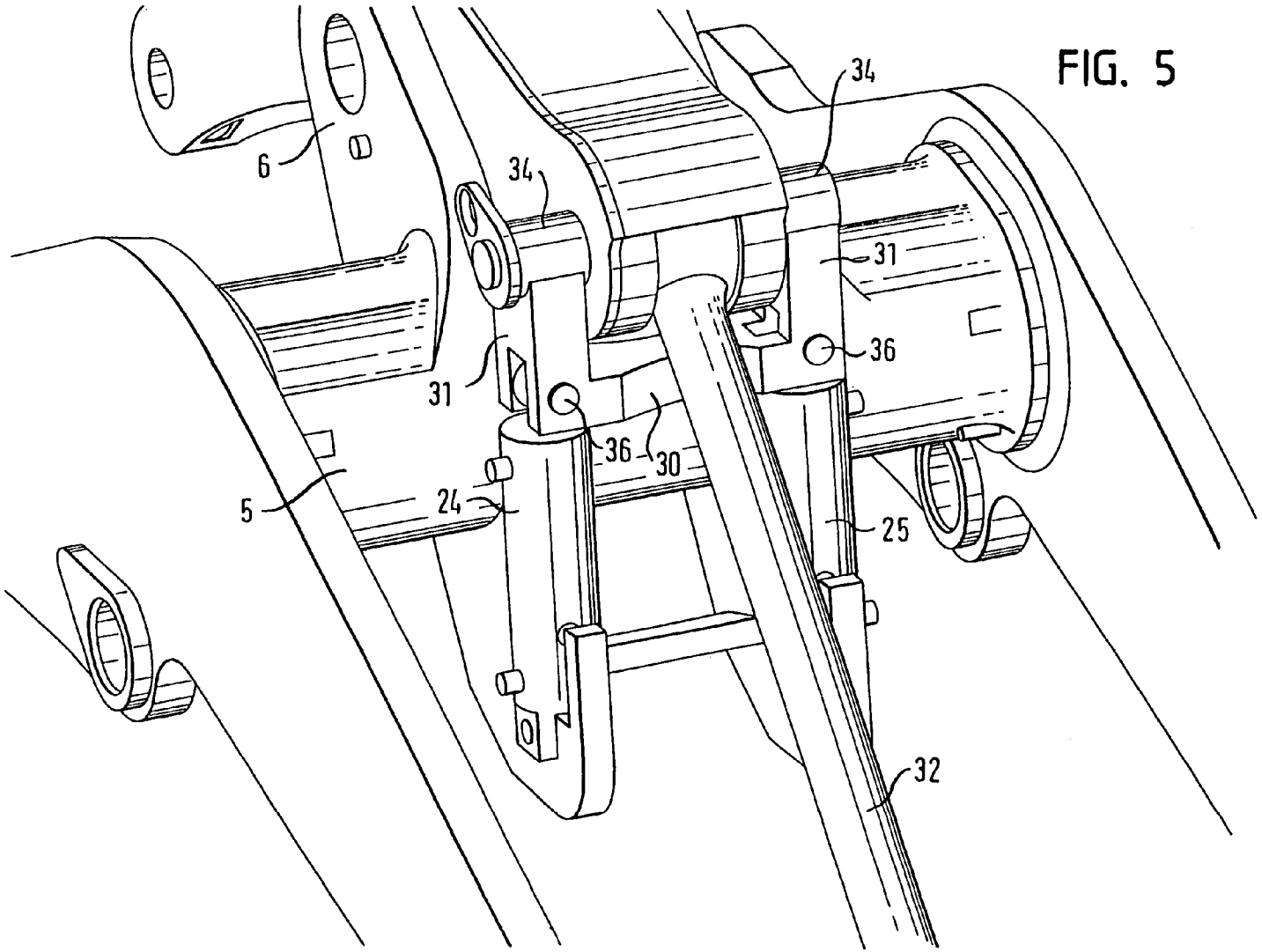
Figure 6:
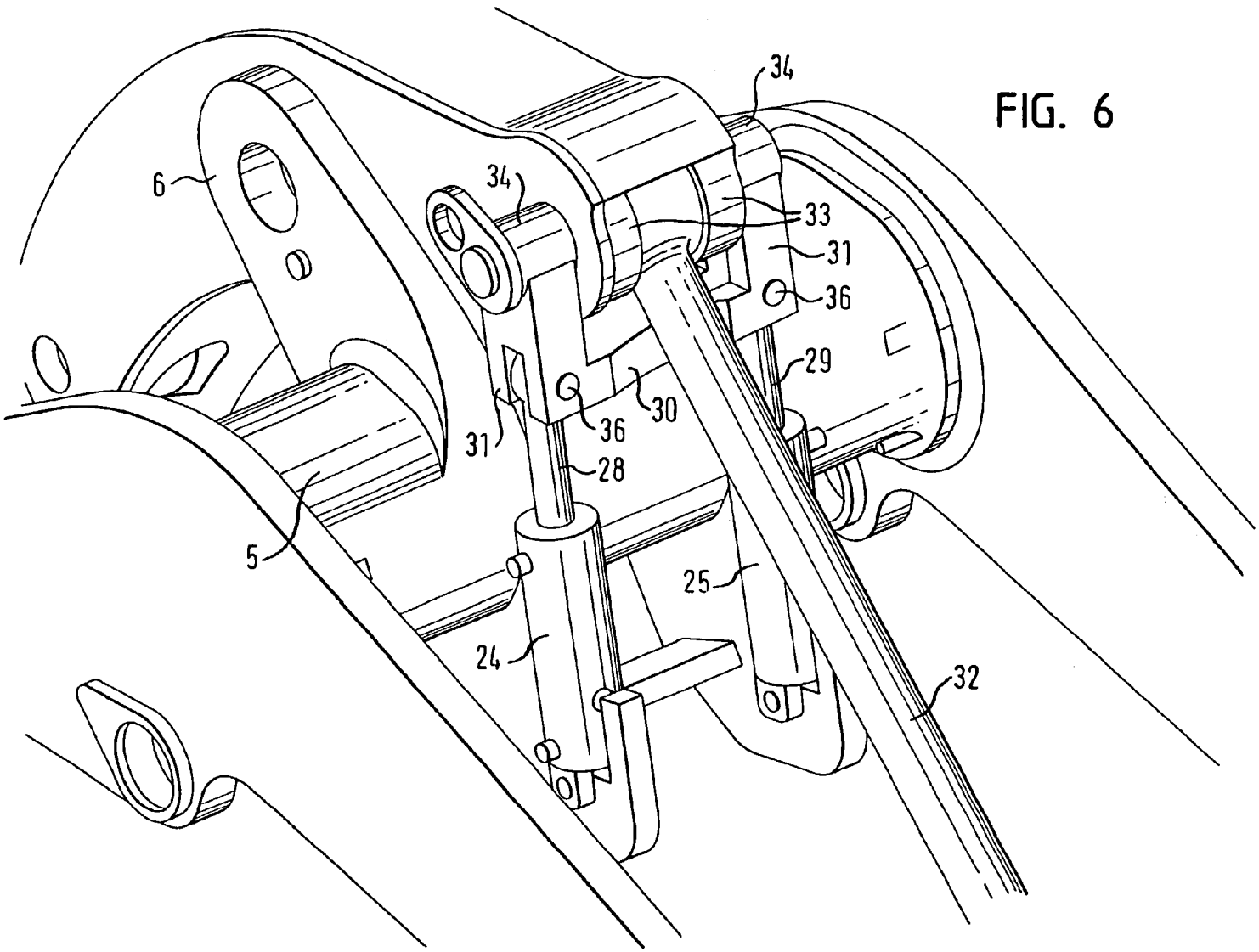
Figure 7:
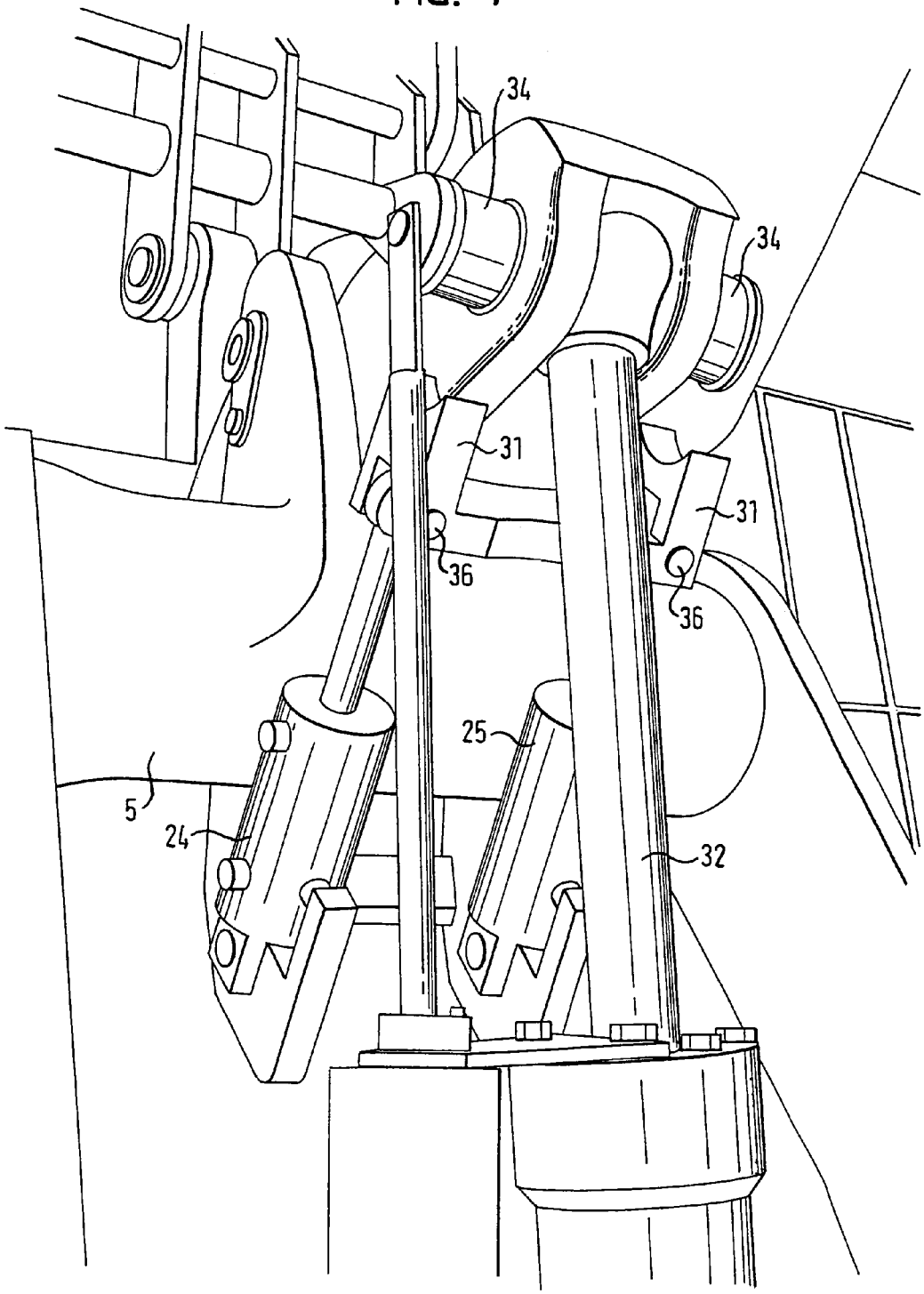

In the position of the attachment shown FIGS. 1 and 2, in the example of embodiment shown that of the bucket, the latter is in its position tipped downwards with the lifting frame raised. In this position, the tipping cylinder engages along line of application 38 solely via relatively short lever arm length a' with the inner arm of the reversing lever. In this position, however, supporting cylinders 24, 25, whose lines of application are indicated by 39, engage via a relatively large active lever arm length b' with the inner arm of the reversing lever, so that the attachment, or more precisely the bucket, can be swivelled upwards with a large moment.

As the bucket is increasingly swivelled upwards, active lever length a", with which the tipping cylinder engages the inner lever arm of the reversing lever, increases, as shown in FIG. 4. FIG. 4 shows the position in which the piston rods of supporting cylinders 24, 25 are fully extended. When piston rod 32 of tipping cylinder 9 is extended further, the axle-end pivots, or more precisely the bearing rings 34 placed on the latter, rise from bearing shells 31 in the manner shown in FIG. 7, since the tipping cylinder, on account of the extended lever arm length, is capable of performing a sufficient moment for the further swivelling upwards of the attachment.

If the attachment is tipped downwards as a result of piston rod 32 of tipping cylinder 9 being retracted, the axle-end pivots or bearing rings 34 again engage with bearing shells 31 of supporting cylinders 24, 25. In this situation, supporting hydraulic cylinders 24, 25 cause a damping effect as a result of the fact that the hydraulic oil forced from the latter flows back into the tank via the same line that also connects the tipping cylinder with the tank, so that the necessary throttling takes place in this line.

A second example of embodiment of the invention is described below with the aid of FIGS. 9 to 16.

Figure 15:
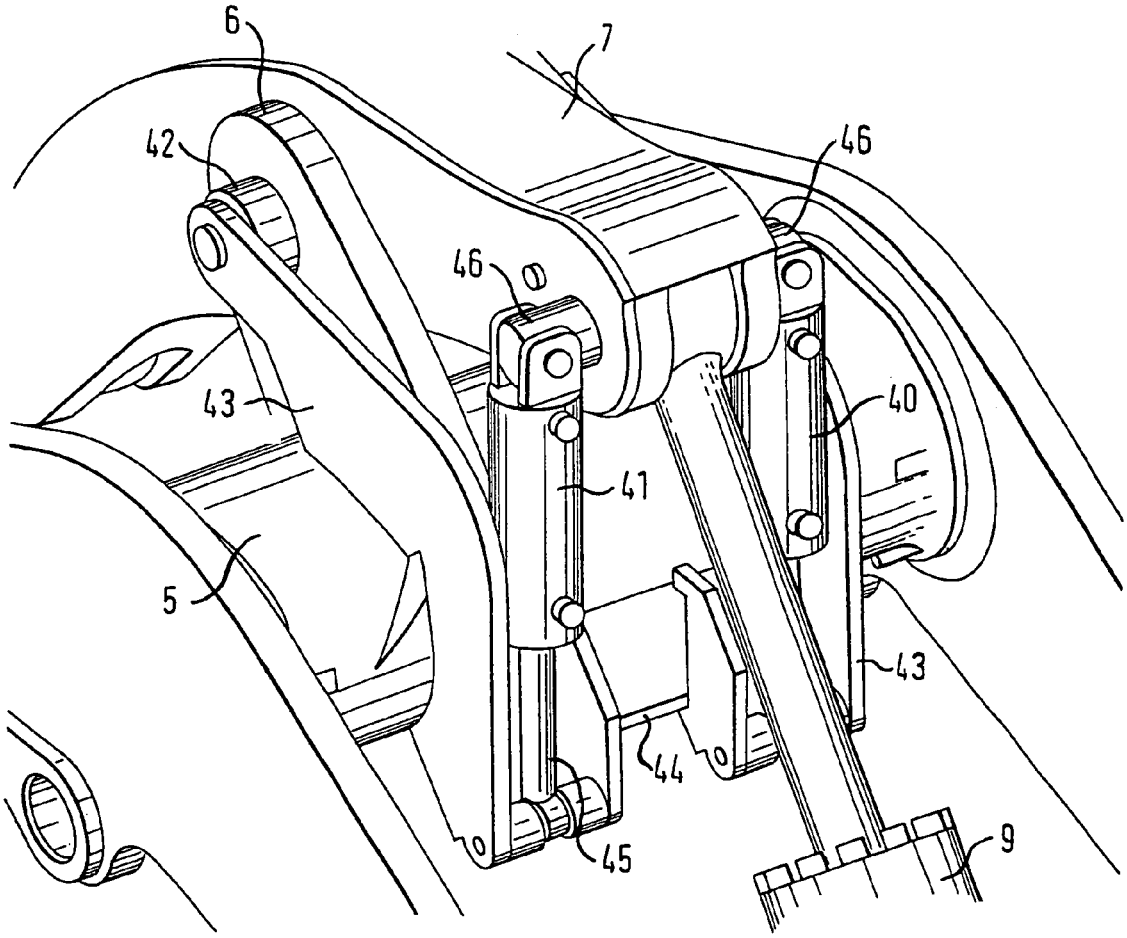
Figure 16:
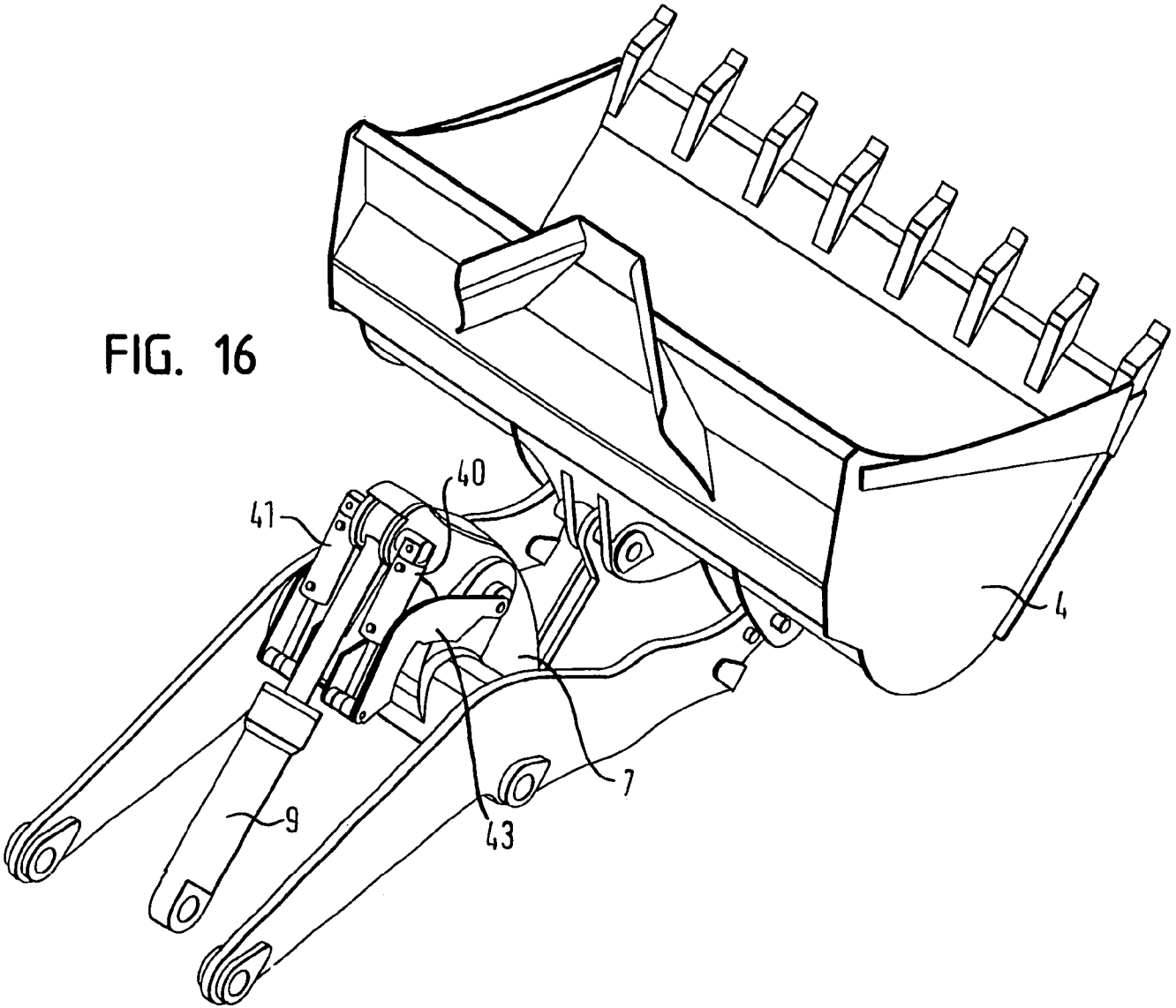

The nature of the arrangement of supporting hydraulic cylinders 40, 41 can best be seen in FIGS. 15 and 16.

One of the ends of guide levers 43 is connected in an articulated manner with projecting axle-end pivots 42 of the swivel axle supporting reversing lever 7 between fork-shaped bearing legs 6 of transverse tube 5, the other ends of said guide levers being connected together by a web part 44, so that guide levers 43 form the legs of a U-shaped carrier part. Guide levers 43 or legs are curved in an arc-shape in the manner shown, so that they are able to rest on transverse tube 5 in predetermined swivelling positions.

Web part 44 is provided with bearing forks for piston rods 45 of hydraulic cylinders 40, 41. Cylinders 40, 41 of the supporting pressure-medium piston-cylinder units are connected in an articulated manner by projecting axle-end pivots 46 of the piston rod of tipping cylinder 9 to swivel axle 8 which swivels reversing lever 7.

The guide levers or legs 43 of the U-shaped carrier part are basically supported in the same swivelling positions of the lifting frame and bucket 4 on transverse tube 5 as the support bearings of the piston rods of supporting hydraulic cylinders 24, 25 with axle-end pivots 34 of swivel axle 8 connecting the piston rod of tipping cylinder 9 with reversing lever 7.

Figures 9, 10:
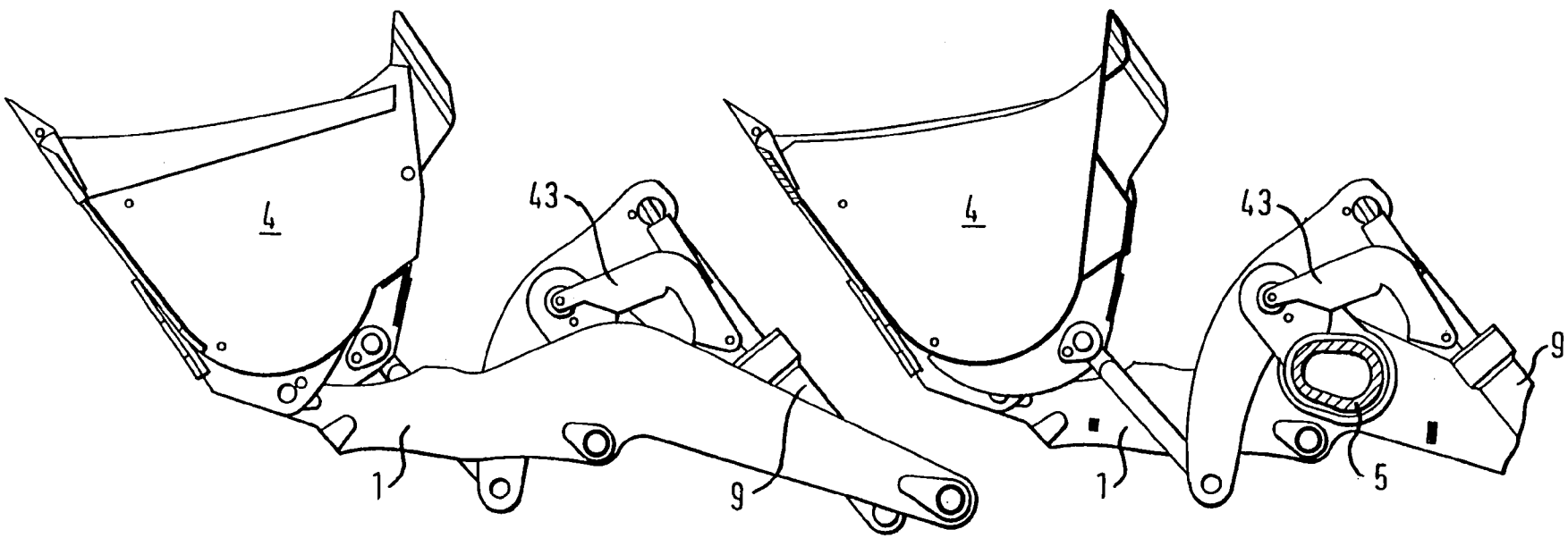

Accessory arm 1 in its lowered position with bucket 4 swivelled upwards is shown in side view in FIG. 9 and in cross-section in FIG. 4. In the position shown, supporting cylinders 40, 41 are extended, as also tipping cylinder 9, and guide levers 43 or the bearing frame formed by the latter are not supported on transverse tube 5.

Figure 12:
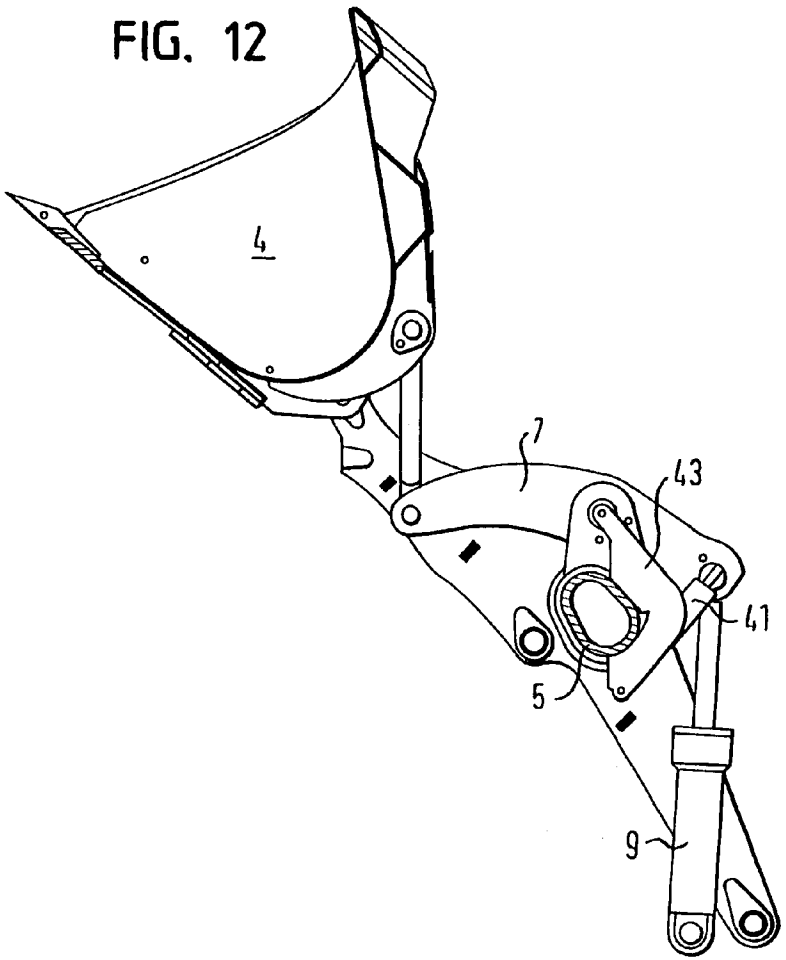
Figure 11:
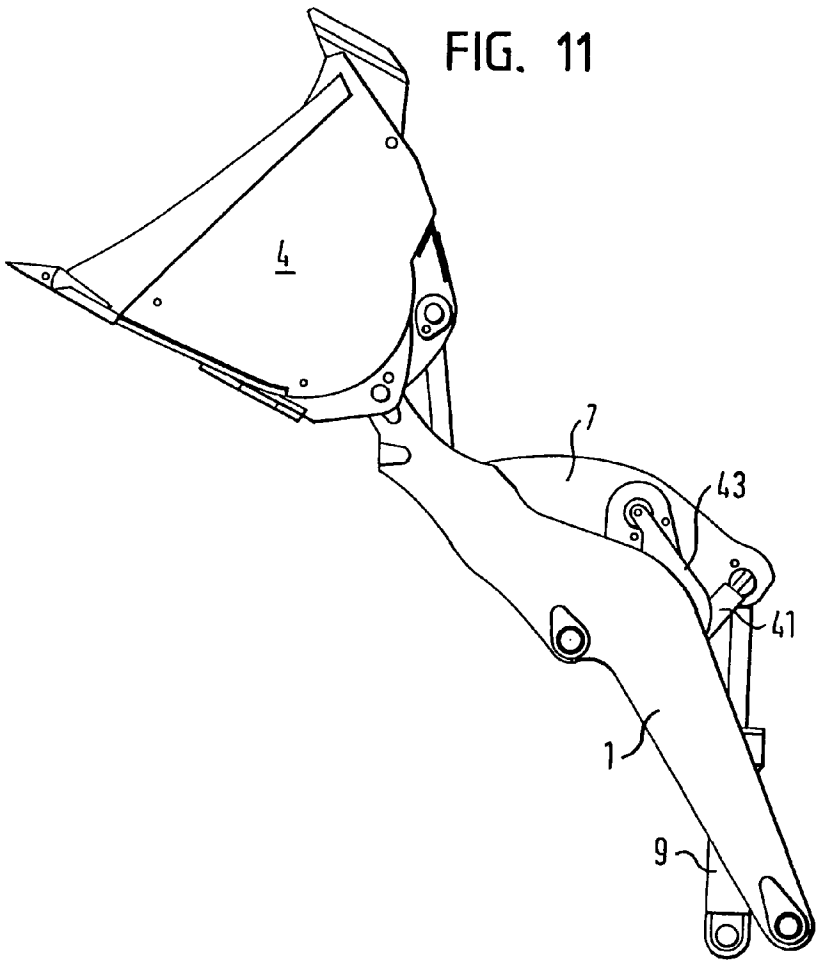

FIGS. 11 and 12 show a representation of the lifting frame corresponding to FIGS. 9 and 10 in a position in which accessory arm 1 is swivelled upwards and bucket 4 is also in a position in which it is swivelled upwards, from which however it cannot be swivelled further in the clockwise direction. In the position shown in FIGS. 11 and 12, supporting cylinders 40, 41 are extended up to their end positions, so that guide levers 43 rise from transverse tube 5 as a result of a further extension of tipping cylinder 1 and further swivelling of bucket 4.

Figure 14:
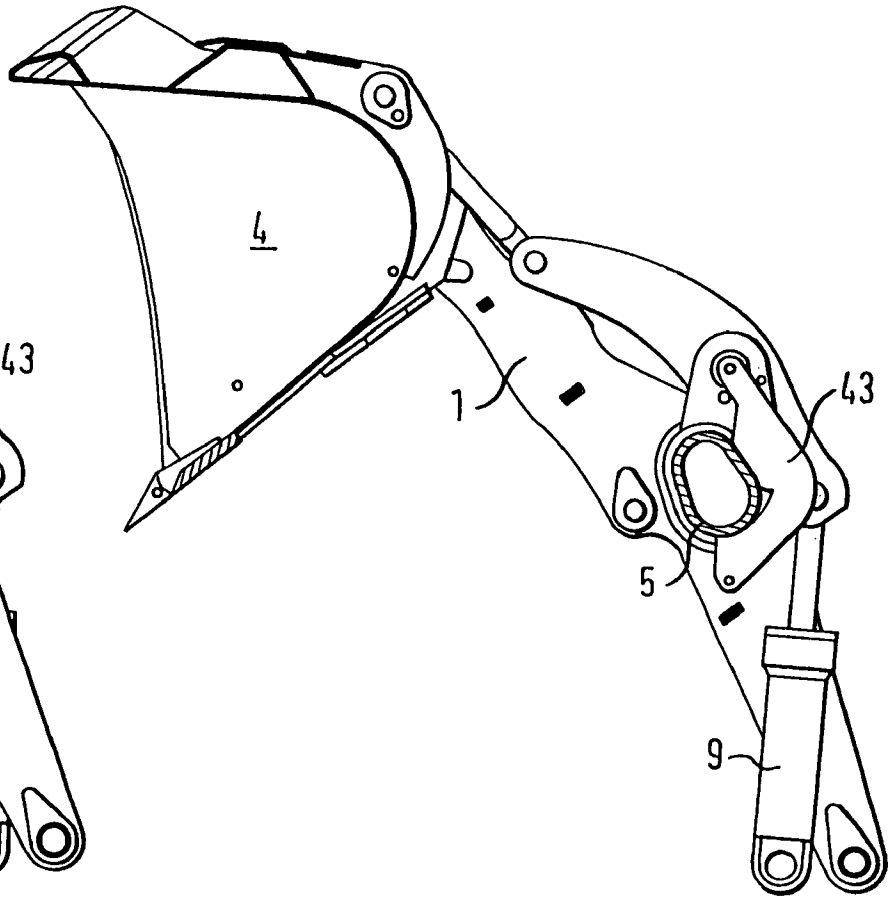
Figure 13:
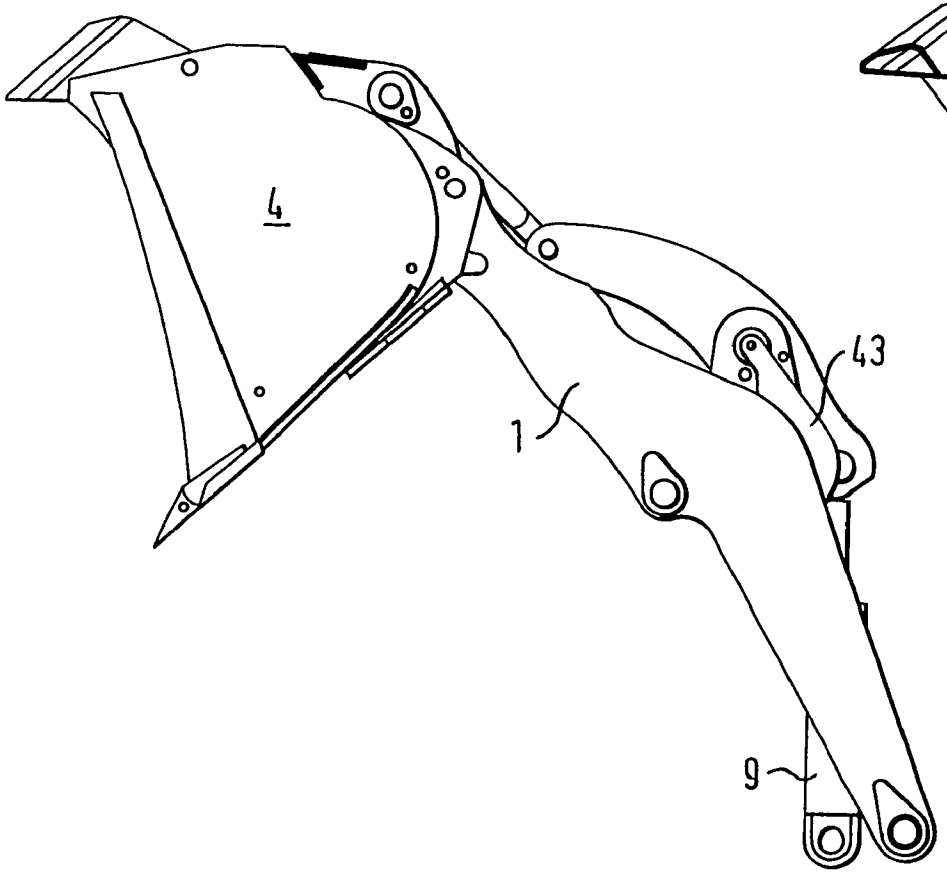

FIGS. 13 and 14 show a representation according to FIGS. 11 and 12, in which accessory arm 1 is swivelled upwards and bucket 4, contrary to the position according to FIGS. 11 and 12, is swivelled downwards in the anticlockwise direction. In this position, legs 43 of the carrier part rest on transverse tube 5 in the manner shown.

The invention claimed is:

1. A wheel loader, comprising a lifting frame having Z-kinematics, an accessory arm (1)

a lifting cylinder (14) coupled to the accessory arm (1) and vehicle frame or a truck front-end, a rocker-type reversing lever (7), a tipping cylinder (9) and connecting link (12) coupled to opposite ends of the reversing lever (7), a swivel axle (8) coupling the tipping cylinder (9) to the reversing lever (7), said connecting link (12) arranged to be coupled to an attachment (4) for swiveling the same, an articulated joint (10) arranged to couple the tipping cylinder (9) to the vehicle frame, and in a direction of the attachment (4) and in front of the articulated joint (10), at least one additional hydraulic cylinder (24, 25) coupling the vehicle frame and comprising a piston rod (28, 29) arranged to engage the swivel axle (8) in an articulated manner.

2. The wheel loader according to claim 1, wherein the attachment (4) is a bucket or log loader.

3. The wheel loader according to claim 2, wherein pressure oil is applied to the supporting hydraulic cylinder (24, 25) simultaneously together with the tipping cylinder (9).

4. The wheel loader according to claim 3, wherein with an accessory arm designed H-shaped and with reversing lever (7) coupled to a transverse tube (5) forming the H-web, the transverse tube is provided with bearing pieces (21) for coupling the hydraulic cylinder (24, 25).

5. The wheel loader according to claim 2, wherein, with an accessory arm designed H-shaped and with reversing lever (7) coupled to a transverse tube (5) forming the H-web, the transverse tube is provided with bearing pieces (21) for coupling the hydraulic cylinder (24, 25).

6. A wheel loader with a lifting frame with Z-kinematics, which comprises an accessory arm (1) with a lifting cylinder (14) coupled to the vehicle frame or to a truck front-end and a rocker-type reversing lever (7) coupled to the accessory arm (1), to the ends of which reversing lever a tipping cylinder (9) and connecting link (12) are coupled for swiveling of an attachment (4), whereby attachments are mountable on the lifting frame, wherein in the direction of the attachment (4) in front of an articulated joint (10) connecting the tipping cylinder (9) to the vehicle frame, there is coupled with the lifting frame at least one hydraulic cylinder (24, 25), of which a piston rod (28,29) engages in an articulated manner with a swivel axle (8) connecting the reversing lever (7) with the tipping cylinder (9), and the supporting hydraulic cylinder (24, 25) is engaged as a damping cylinder when the tipping cylinder (9) performs a movement retracting the piston rod (32).

7. The wheel loader according to claim 6, wherein the supporting hydraulic cylinder (24, 25) is held on the lifting frame in such a way to have a limited swivelling capacity and its piston rod (28, 29) carries an open saucer-shaped supporting bearing (31), which disengages from the swivel axle (34) connecting the reversing lever with the tipping cylinder when, with the lifting frame raised and with the attachment swivelled upwards, the tipping cylinder (9) engages with the reversing lever via a larger lever arm.

8. The wheel loader according to claim 6, wherein with an accessory arm designed H-shaped and with reversing lever (7) coupled to a transverse tube (5) forming the H-web, the transverse tube is provided with bearing pieces (21) for coupling the hydraulic cylinder (24, 25).

9. A loader with a lifting frame with Z-kinematics, which comprises an accessory arm (1) with a lifting cylinder (14) coupled to the vehicle frame or to a truck front-end and a rocker-type reversing lever (7) coupled to the accessory arm (1), to the ends of which reversing lever a tipping cylinder (9) and connecting link (12) are coupled for swiveling of an attachment (4), whereby attachments are mountable on the lifting frame, wherein in the direction of the attachment (4) in front of an articulated joint (10) connecting the tipping cylinder (9) to the vehicle frame, there is coupled with the lifting frame at least one one hydraulic cylinder (24, 25), of which a piston rod (28,29) engages in an articulated manner with a swivel axle (8) connecting the reversing lever (7) with the tipping cylinder (9), and the supporting hydraulic cylinder (24, 25) is held on the lifting frame in such a way to have a limited swivelling capacity and its piston rod (28, 29) carries an open saucer-shaped supporting bearing (31), which disengages from the swivel axle (34) connecting the reversing lever with the tipping cylinder when, with the lifting frame raised and with the attachment swivelled upwards, the tipping cylinder (9) engages with the reversing lever via a larger lever arm.

10. The wheel loader according to claim 9, wherein with an accessory arm designed H-shaped and with reversing lever (7) coupled to a transverse tube (5) forming the H-web, the transverse tube is provided with bearing pieces (21) for coupling the hydraulic cylinder (24, 25).

11. A wheel loader with a lifting frame with Z-kinematics, which comprises an accessory arm (1) with a lifting cylinder (14) coupled to the vehicle frame or to a truck front-end and a rocker-type reversing lever (7) coupled to the accessory arm (1), to the ends of which reversing lever a tipping cylinder (9) and connecting link (12) are coupled for swiveling of an attachment (4), whereby attachments are mountable on the lifting frame, wherein in the direction of the attachment (4) in front of an articulated joint (10) connecting the tipping cylinder (9) to the vehicle frame, there is coupled with the lifting frame at least one one hydraulic cylinder (24, 25), of which a piston rod (28,29) engages in an articulated manner with a swivel axle (8) connecting the reversing lever (7) with the tipping cylinder (9), and two hydraulic cylinders (24, 25) are connected to a transverse tube (5) in such a way to have a limited swivelling capacity, the piston rods (28, 29) of which hydraulic cylinders being connected together by a cross yoke (3) which carries a support bearing (31).

12. The wheel loader according to claim 11, wherein the swivel axle (8), with which the piston rod (32) of the tipping cylinder (9) engages, is lengthened laterally over legs (33) of a bearing fork connecting the latter with the reversing lever (7), thereby forming axle-end pivots (34), and lateral support bearings (31) connected to the cross yoke (30) engage with these axle-end pivots.

13. The wheel loader according to claim 12, wherein each of the two hydraulic cylinders (24, 25) is connected to the transverse tube (5) by a U-shaped holding part (21), one leg (23) of which is welded to the transverse tube (5), each hydraulic cylinder (24, 25) is connected to a web part of each holding part (21) about a swivel axle parallel to the transverse tube (5), and the legs are provided on their insides with buffering stops (27), between which the cylinders (24, 25) are capable of swivelling.

14. The wheel loader according to claim 11, wherein each of the two hydraulic cylinders (24, 25) is connected to the transverse tube (5) by a U-shaped holding part (21), one leg (23) of which is welded to the transverse tube (5), each hydraulic cylinder (24, 25) is connected to a web part of each holding part (21) about a swivel axle parallel to the transverse tube (5), and the legs are provided on their insides with buffering stops (27), between which the cylinders (24, 25) are capable of swivelling.

15. The wheel loader according to claim 11, wherein pressure oil is applied to the supporting hydraulic cylinder (24, 25) simultaneously together with the tipping cylinder (9).

16. A wheel loader with a lifting frame with Z-kinematics, which comprises an accessory arm (1) with a lifting cylinder (14) coupled to the vehicle frame or to a truck front-end and a rocker-type reversing lever (7) coupled to the accessory arm (1), to the ends of which reversing lever a tipping cylinder (9) and connecting link (12) are coupled for swiveling of an attachment (4), whereby attachments are mountable on the lifting frame, wherein in the direction of the attachment (4) in front of an articulated joint (10) connecting the tipping cylinder (9) to the vehicle frame, there is coupled with the lifting frame at least one one hydraulic cylinder (24, 25), of which a piston rod (28,29) engages in an articulated manner with a swivel axle (8) connecting the reversing lever (7) with the tipping cylinder (9), and one end of a guide lever (43) is coupled with the reversing lever (7) or a radial arm or a bearing a leg of a transverse tube (5) connecting lateral accessory arms in an H-shape, a side of a supporting hydraulic pressure-medium piston-cylinder unit (40, 45) being connected to the other end of said guide lever, the other end of the pressure-medium piston-cylinder unit (40, 41) is coupled with or in the vicinity of the swivel axle (8, 46) connecting the reversing lever (7) with the tipping cylinder (9), and the guide lever (43) rests temporarily on the transverse tube for the purpose of supporting the tipping cylinder (9) during the extension of the pressure-medium piston-cylinder unit (41).

17. The wheel loader according to claim 16, wherein the guide lever (43) is mounted in an articulated manner on the swivel axle of the reversing lever (7), which swivel axle is held by fork-shaped bearing legs (6) connected to the transverse tube (5).

18. The wheel loader according to claim 17, wherein two guide levers (43) are mounted on each side of the reversing lever (7), said guide levers being connected together in a U-shape by a web part (44), and there are mounted on the guide levers (43) or the web part (44) two pressure-medium piston-cylinder units (40, 41), whose other ends are connected in an articulated manner with projecting axle-end pivots (46) of the swivel axle (8) connecting the reversing lever (7) with the tipping cylinder (9).

19. The wheel loader according to claim 16, wherein two guide levers (43) are mounted on each side of the reversing lever (7), said guide levers being connected together in a U-shape by a web part (44), and there are mounted on the guide levers (43) or the web part (44) two pressure-medium piston-cylinder units (40, 41), whose other ends are connected in an articulated manner with projecting axle-end pivots (46) of the swivel axle (8) connecting the reversing lever (7) with the tipping cylinder (9).

* * * * *